US006953051B2

(12) United States Patent
An et al.

(10) Patent No.: US 6,953,051 B2
(45) Date of Patent: Oct. 11, 2005

(54) VALVE PLATE STRUCTURE

(75) Inventors: Kwang Hyup An, Seoul (KR); Jeong Ho Lee, Goyang-si (KR); In Seop Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/002,157

(22) Filed: Dec. 5, 2001

(65) Prior Publication Data

US 2002/0170604 A1 Nov. 21, 2002

(30) Foreign Application Priority Data

May 15, 2001 (KR) ..... 2001-26314

(51) Int. Cl.[7] ..... F16K 21/10; F16K 15/16

(52) U.S. Cl. ..... 137/514; 137/855; 417/569; 417/571

(58) Field of Search ..... 137/855, 856, 137/857, 858, 514, 514.5; 417/312, 569, 571

(56) References Cited

U.S. PATENT DOCUMENTS 1,416,696 A * 5/1922 Dennedy ..... 417/550
1,768,638 A * 7/1930 Sheats ..... 137/514
2,158,351 A * 5/1939 Ames et al. ..... 417/553
2,161,769 A * 6/1939 Trask ..... 137/857
2,302,447 A * 11/1942 King et al. ..... 137/514
3,037,523 A * 6/1962 Szaniszio' ..... 137/514
4,398,559 A * 8/1983 Bunn et al. ..... 137/516.15
4,444,219 A * 4/1984 Hollenstein ..... 137/246
5,228,468 A * 7/1993 Kapadia ..... 137/514
5,380,176 A * 1/1995 Kikuchi et al. ..... 137/856
5,452,994 A * 9/1995 Erickson ..... 417/550
5,703,336 A * 12/1997 Tark et al. ..... 181/179
5,722,818 A * 3/1998 Ohta et al. ..... 417/312
5,884,665 A * 3/1999 Thurston et al. ..... 137/856
6,006,786 A * 12/1999 Ito ..... 137/856
6,176,687 B1 * 1/2001 Kim et al. ..... 417/312
6,196,815 B1 * 3/2001 Ohtake ..... 137/856

* cited by examiner

*Primary Examiner*—Ramesh Krishnamurthy
(74) *Attorney, Agent, or Firm*—Birch, Stewart Kolasch & Birch, LLP

(57) ABSTRACT

Disclosed is a valve plate structure comprising: a suction valve for inhaling a low pressure of coolant through a linear reciprocating movement of a piston and an opening and closing operation in response to the back-and-forth movement; a valve plate coupled with the suction valve, and including a suction port for inducing the low pressure of coolant through the piston movement, a discharging port for discharging a high pressure of coolant through piston movement and a groove section having a plurality of cavities provided to surround the outside of the suction port or the discharging port; a discharging valve coupled with the valve plate for discharging the high pressure coolant through the back-and-forth movement of the piston and the opening/shutting operation in response to the back-and-forth movement; and a head cover coupled with the discharging valve, and including a suction tube formed at a position corresponding to the suction port of the valve plate and a discharging tube formed at a position corresponding to the discharge port of the valve plate. The grooves formed of the plurality of cavities can damp vibration and noise having wide bands of frequency and amplitude generated from collision between the valve plate and the suction and discharging valves.

17 Claims, 7 Drawing Sheets

VALVE PLATE STRUCTURE

BACKGROUND OF THE INVENTION

1. Field of the Invention

The present invention pertains generally to suction and discharge valves, and more particularly to a valve plate structure having capabilities of reducing noise and vibration generated when suction and discharging valves collide into a valve plate in shutting the same.

2. Description of the Related Art

FIG. 1 shows an enclosed electric compressor of the related art.

As shown in FIG. 1, a crank shaft is fastened to a rotor (not shown) and a stator (not shown) which are electrical components, and one ends of a rotor and a stator are connected to a piston 19. The piston 19 and a cylinder 7 are installed in a cylinder block which is configured with the cylinder 7 to form a single body. Also, the cylinder 7 is coupled with a suction valve 20, a valve plate 22, a discharge valve 26 and a head cover 28 in a bolt-coupling manner.

In a reciprocating compressor of the related art, a crank shaft 3 is rotated at a certain number of revolution by rotating force of the rotor and the stator which are power transmitting components. The rotational motion is converted into reciprocal straight line motion by a sleeve 16 and a connecting rod 17. A piston 19 is fastened to the connecting rod 17, and moves back and forth within the cylinder 7. By back and forth motion of the piston 19, coolant is inhaled through the suction valve 20 and discharged through the discharging valve 26 after being compressed under the high pressure.

FIG. 2A to FIG. 2D show disassembled views of a head cover, the valve plate, the suction valve and the discharging valve.

The valve plate 22 supports the suction valve 20 and the discharging valve 26, and controls the flow of fluid that goes in and comes out of the cylinder 7. The valve plate 22 includes a suction port 221 for intake the fluid and a discharging port 222 for discharging fluid.

The suction valve 20 is positioned between the valve plate 22 and the cylinder 7, and has a suction plate 201 formed at a position corresponding to the suction port 221 of the valve plate 22.

Also, the discharge valve 26 is positioned between the valve plate 22 and the head cover 28, and has a discharging plate 261 formed at a position corresponding to the discharge port 222 of the valve plate 22.

As shown in FIG. 2A, the head cover 28 determines a flow passage for fluid that goes in and comes out of the cylinder, and also includes a mounting surface for mounting a suction muffler 27 at one side thereof and the upper part of the other side is mounted with the valve plate 22. The head cover 28 also includes a suction tube formed at a place corresponding to the suction port 221 of the valve plate 22 and a discharging tube formed at a position corresponding to the discharging port 222.

The head cover 28 configured as above has the upper end to which the valve plate 22 is mounted and the lower end to which the suction valve 20 is mounted. In general, the discharge valve 26 and the suction valve 20 are made of steel and have a thickness of about 1 or 2 t. Meanwhile, the valve plate 22 has a thickness of 3 or 5 t which is thicker than the valves 20 and 26.

The following are the description of the suction, compression and discharge steps of the compressor.

When the piston 19 moves from the top dead center to the bottom dead center, the suction valve 20 opens as the pressure within the cylinder 7 becomes lower than the suction muffler 27. The suction valve 20 remains opened allowing a coolant to be introduced into the cylinder 7 until the pressure within the cylinder 7 becomes the same as the pressure in the suction muffler 27.

Also, when the piston 19 moves from the bottom dead point to the top dead point, internal pressure of the cylinder 7 is successively elevated to compress the coolant. When such internal pressure of the cylinder 7 becomes larger than spring force of the discharging valve 26, the discharge valve 26 is opened to form a passage through which the high pressure of the coolant is discharged from the cylinder.

As shown above, when the rotor revolves for one time the, operation of the suction valve 20 and the discharge valve 26 is initiated and suction and discharge of coolant into and from the cylinder 7 is carried out. When the suction and discharge valves 20 and 26 are closed, the suction and discharge valves 20 and 26 collide into the valve plate 22 thereby generating noise and vibration. The loudness of the collision noise depends on a vibration transmission capability of the valve plate 22.

Also, such vibration is transferred to the valve plate 22 and then transmitted to the whole compressor via a contact area of the valve plate 22 and the bolt that fastens the valve plate 22.

If the vibration transferred to the compressor coincides with the resonant frequency, then severe problems such as noise and fracture may occur, and most of the time it has a large effect on noise generation due to the high frequency component.

In order to reduce such vibration and noise, a cavity is provided at the one portion of the outside of the discharging port and a suction muffler is provided in the suction port.

However, due to the limitation on the volume of the cavity, reducing the whole energy of transmitted noise is limited. Also, it is difficult to reduce noise under a certain reference value.

Further, another disadvantage is that a vibration mode of the valve plate 22 does not absorb impact or collision sound, thereby generating loud noise.

SUMMARY OF THE INVENTION

Accordingly, the present invention has been proposed to solve the foregoing problems of the related art and it is an object of the invention to provide a valve plate structure which comprises a number of grooves to minimize vibration and noise generated from a collision between valves and a valve plate.

According to an embodiment of the invention to solve the object, it is provided a valve plate structure comprising: open/shut means for inhaling/discharging fluid through piston movement; and a valve plate including a suction port coupled with the open/shut means for inhaling fluid through piston movement, a discharging port for discharging fluid through piston movement and a groove section having a plurality of cavities provided to surround the outside of the suction port or the discharging port.

It is preferred that the open/shut means includes: a suction valve having a suction plate at a position corresponding to the suction port of the valve plate to intake fluid through piston movement; a discharging valve having a discharge plate at a position corresponding to the discharge port of the valve plate to discharge fluid; and a head cover having a suction tube formed at a position corresponding to the suction port of the valve plate and a discharging tube formed at a position corresponding to the discharging port of the valve plate.

It is also preferred that fluid is a coolant and each of the plurality of cavities has a width different from one another.

Also, it is preferred that the cavities are shaped as circle or polygon such as rectangle and octagon, the cavities increase in width as extending away from the center of the suction port or the discharging port of the valve plate, and the cavities are fixed in depth.

It is also preferred that each of the cavities surrounding the suction port or the discharging port of the valve plate has a different shape from one another, and the cavities are shaped as inverse triangle to rapidly decrease in width as extending downward or U-shaped to slowly decrease in width as extending downward.

Further, the open/shut means is preferably operates opening and closing functions via pressure difference.

According to another embodiment of the invention to solve the object, it is provided a valve plate structure comprising: opening/shutting means for inhaling/discharging through piston movement; and a valve plate including a suction port coupled with the open/shut means for inhaling fluid through piston movement, a discharging port for discharging fluid through piston movement and a groove spirally provided to surround the outside of the suction port or the discharging port.

It is preferred that the groove contacts with the suction port or the discharging port at one end thereof and has a spiral shape increasing in width as extending outward.

According to further another embodiment of the invention to solve the object, it is provided a valve plate structure comprising: a suction valve for inhaling a low pressure of coolant through a linear back-and-forth movement of a piston and an opening/shutting operation in response to the back-and-forth movement; a valve plate coupled with the suction valve, and including a suction port for inhaling the low pressure of coolant through the piston movement, a discharging port for discharging a high pressure of coolant through piston movement and a groove section having a plurality of cavities provided to surround the outside of the suction port or the discharging port; a discharging valve coupled with the valve plate for discharging the high pressure coolant through the back-and-forth movement of the piston and the opening/shutting operation in response to the reciprocating movement; and a head cover coupled with the discharge valve, and including a suction tube formed at a position corresponding to the suction port of the valve plate and a discharging tube formed at a position corresponding to the discharging port of the valve plate.

DETAILED DESCRIPTION OF THE PREFERRED EMBODIMENT

Figure 1:
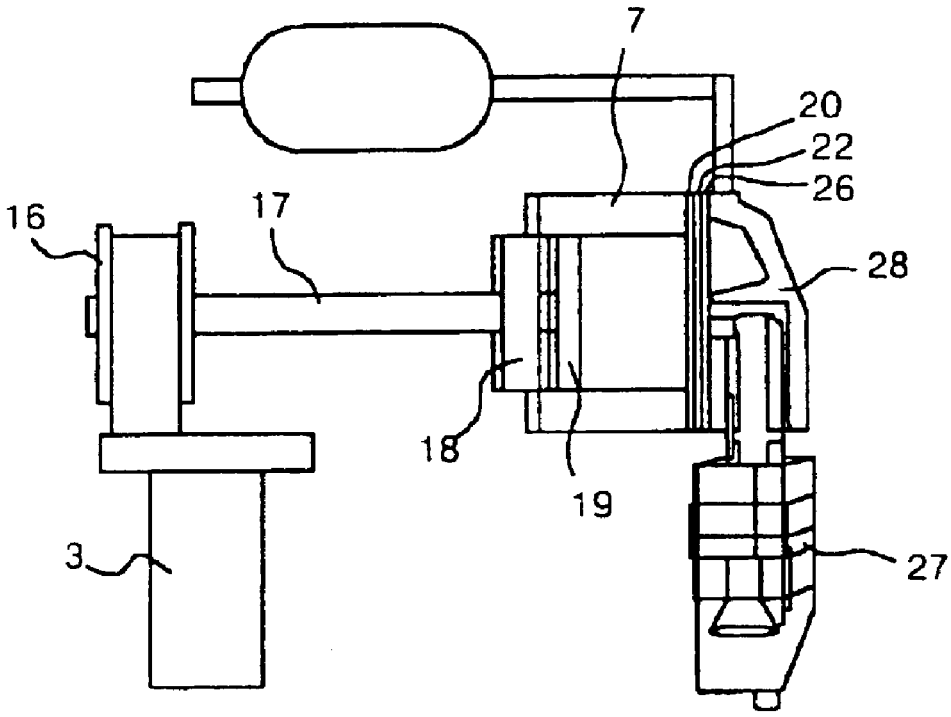
FIG. 1 RELATED ART
FIG. 1 shows a configuration of suction and discharge sections of a compressor of the related art.
Figure 2A:
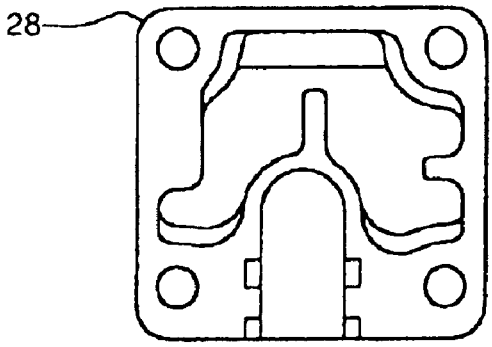
FIG. 2A RELATED ART
FIG. 2A to FIG. 2D are development views for showing valves and heads of the related art.
Figure 2B:
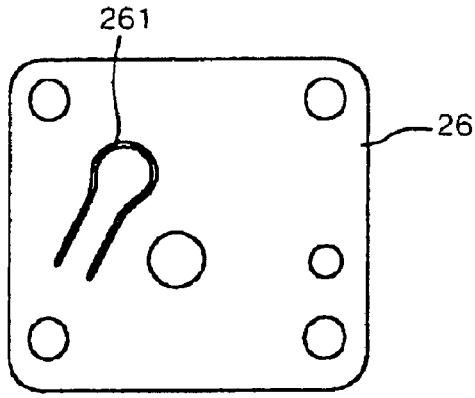
FIG. 2B RELATED ART
Figure 2C:
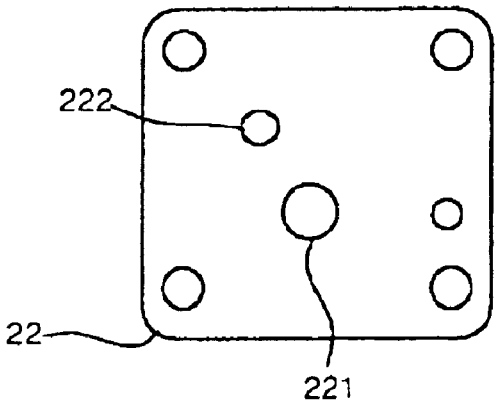
FIG. 2C RELATED ART
Figure 2D:
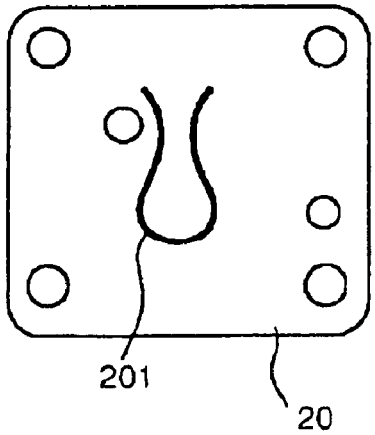
FIG. 2D RELATED ART

Hereinafter a detailed description of the embodiments of the invention is provided in reference to FIGS. 3A to FIG. 10, in which some components of the invention are designated with the same reference numerals as those of the related art for the convenience's sake of explanation.

Figure 3A:
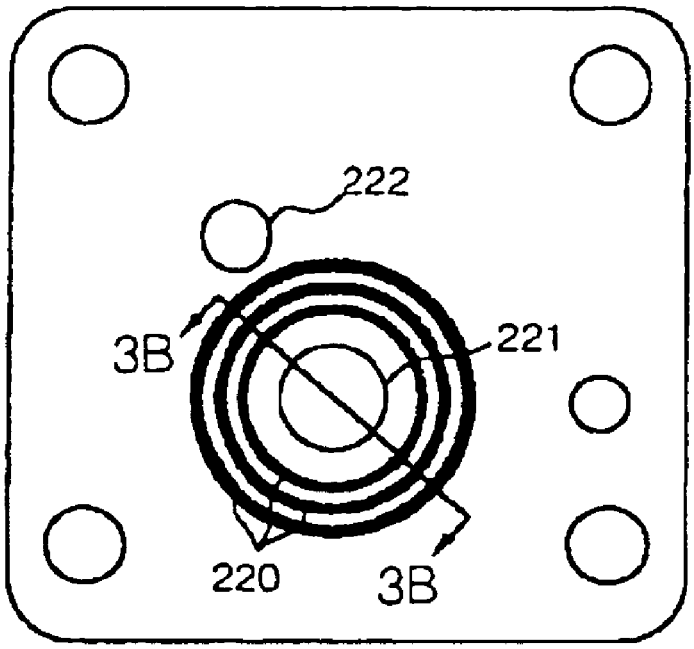
FIG. 3A and FIG. 3B is a plan view and a partial sectional view respectively, showing a valve plate of the present invention.
Figure 3B:
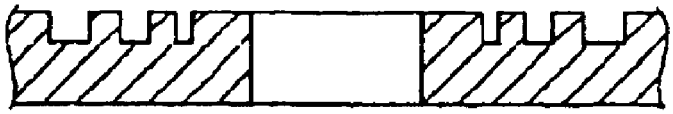

FIG. 3A is a plan view for showing a valve plate 22 of the invention. As shown in FIGS. 3A and 3B, a plurality of circular cavities are outwardly formed about a suction port 221 at a certain portion of the valve plate 22 to define a set of grooves 220. The circular cavities are formed at a certain interval and with different thickness.

Figure 4:
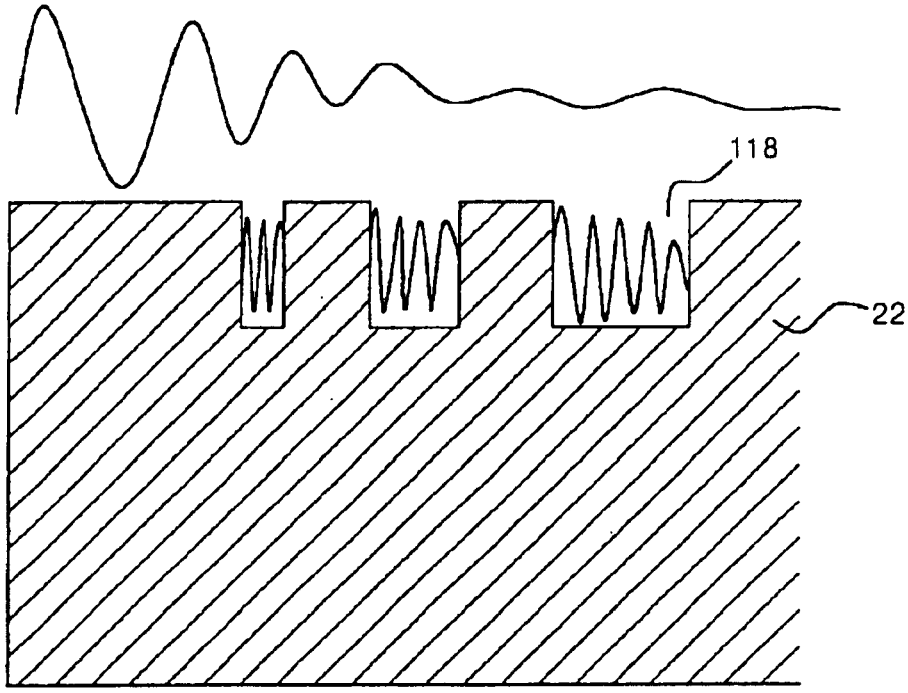
FIG. 4 is a sectional view showing the operational principle of cavities of the present invention.

FIG. 4 shows a sectional view of the valve plate 22.

As shown in FIG. 4, vibration and noise generated from collision of the suction valve 20 and the discharge valve 26 into the valve plate 22 spreads into all directions about a suction port. Noise and vibration are transmitted to the grooves composed of the number of cavities 118 during a spreading process. The cavities 118 are hollow spaces with various widths and respectively have the resonant frequencies pertinent thereto so that only the pertinent frequencies are resonated in the cavities 118, that is, the cavities 118 obstruct transmission of vibration and noise with the frequencies pertinent to the resonant frequencies to damp the amplitude of vibration and noise.

According to such a principle, when the cavities are adjusted in width in correspond to the most problematic bands of vibration and noise generated from collision of the suction and discharge valve 20 and 26 with the valve plate 22.

As shown in FIG. 4, vibration and noise are damped while passing through the inside of one of the cavities 118, and damped vibration and noise are transmitted to the next one of the cavities 118. A damping process is repeated in such a manner. The plurality of cavities 118 are formed in various widths to have different resonant frequencies, and thus can damp vibration and noise in various frequency bands.

Figure 5:
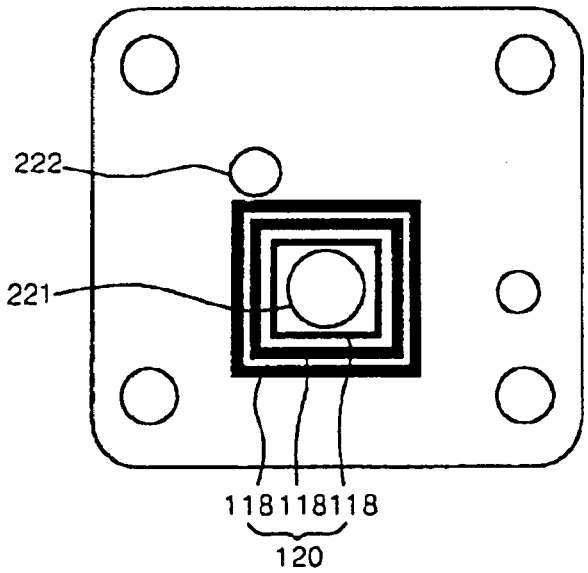
FIG. 5 is a plan view showing the first embodiment of the invention.

FIG. 5 shows grooves 120 formed of a number of rectangular cavities 118.

As shown in FIG. 5, vibration and noise can be damped in frequency bands corresponding to not only the widths of the number of cavities 118 but also the lengths of the rectangles.

Figure 6:
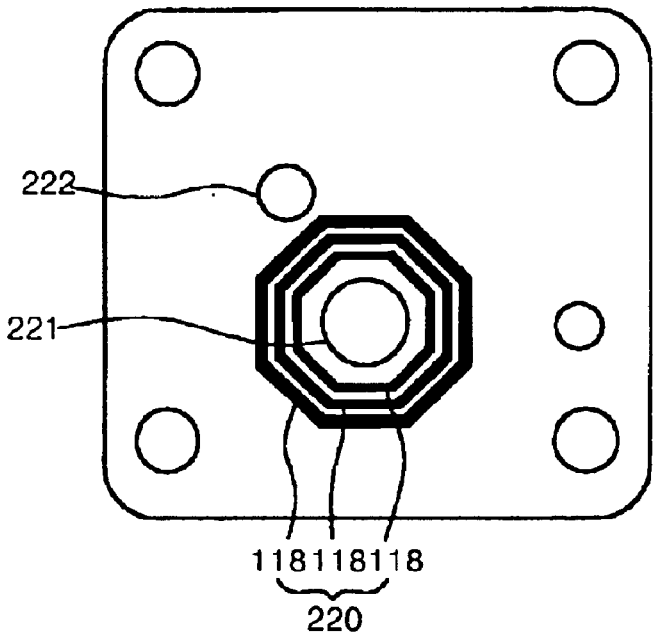
FIG. 6 is a plan view showing the second embodiment of the invention.

FIG. 6 shows grooves 220 formed of octagonal cavities 118.

As shown in FIG. 6, the octagonal cavities 118 have more sides compared to the rectangular cavities to increase frequency bands to be damped.

The cavities 118 of the invention have various shapes other than the foregoing shapes of circle, rectangle and octagon such as triangle, pentagon and the like. The cavities of these shapes can effectively damp vibration and noise belonging to wide frequency bands.

Figure 7:
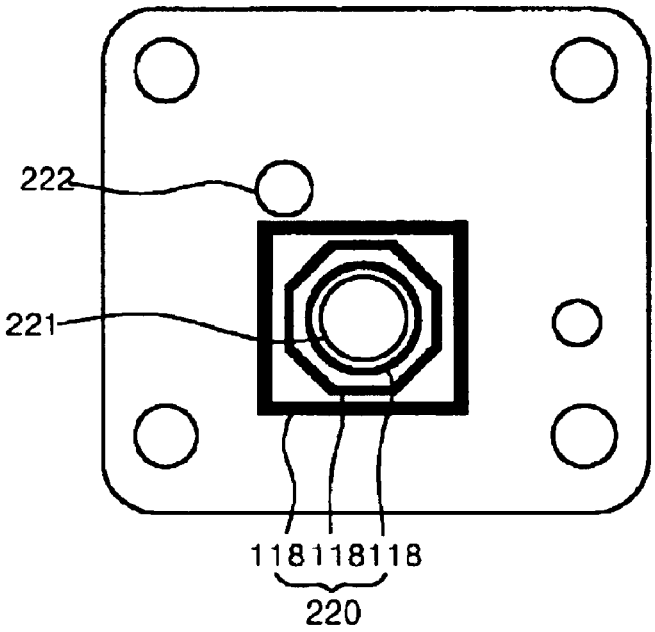
FIG. 7 is a plan view showing the third embodiment of the invention.

FIG. 7 shows grooves 220 in which several shapes of cavities 118 are combined.

As shown in FIG. 7, the grooves 220 in which the cavities are combined with various shapes such as triangle, rectangle, pentagon and the like can damp vibration and noise in wider bands of frequencies and amplitudes than the grooves 220 formed of one kind of cavities. In other words, the grooves 220 formed of one type of cavities can damp vibration and noise having only restricted bands of frequencies and amplitudes.

Figure 8:
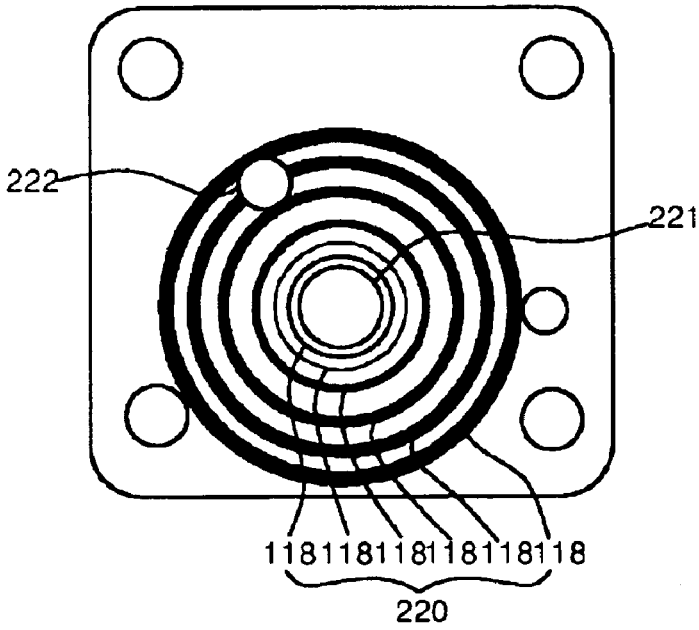
FIG. 8 is a plan view showing the fourth embodiment of the invention.

FIG. 8 shows grooves formed of cavities 118 with different widths.

As shown in FIG. 8, each of the cavities has a width different from one another and thus the natural resonant frequency different from one another to damp a frequency corresponding to the natural resonant frequency.

Figure 9:
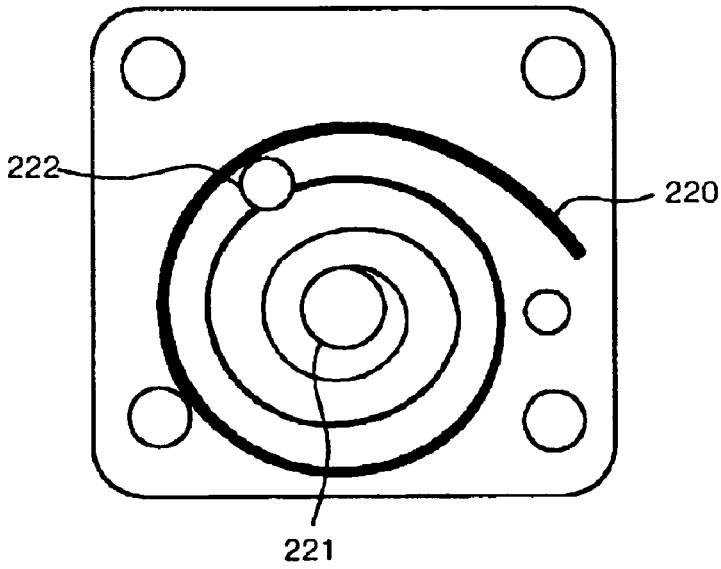
FIG. 9 is a plan view showing the fifth embodiment of the invention.

FIG. 9 shows other embodiment of the invention.

As shown in FIG. 9, a groove 220 is formed of one cavity 118, which contacts with the suction port 221 at one end thereof and has a spiral shape increasing in width as extending outward. The groove 220 of such a spiral shape is formed to continuously increase in width and thus has the features of capable of damping wider bands of vibration and frequency.

Figure 10A:
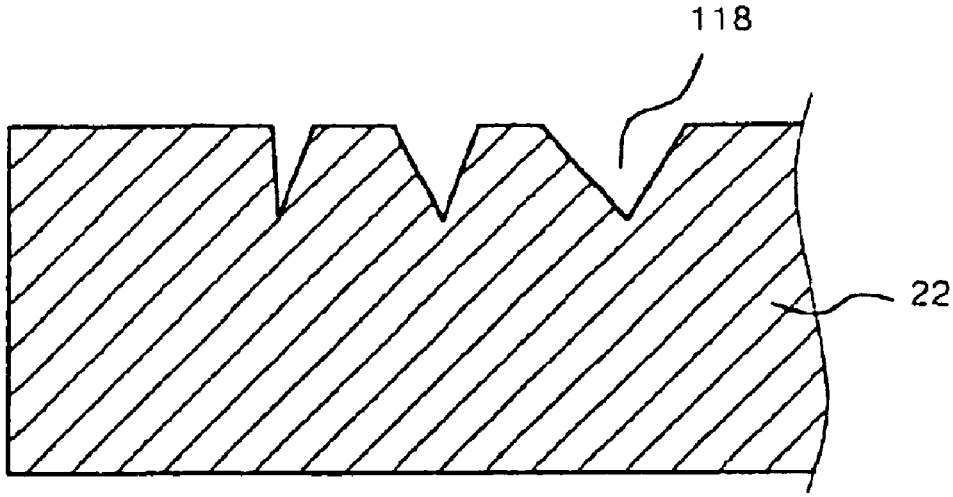
FIGS. 10A and 10B are sectional views showing cavities of the invention.
Figure 10B:
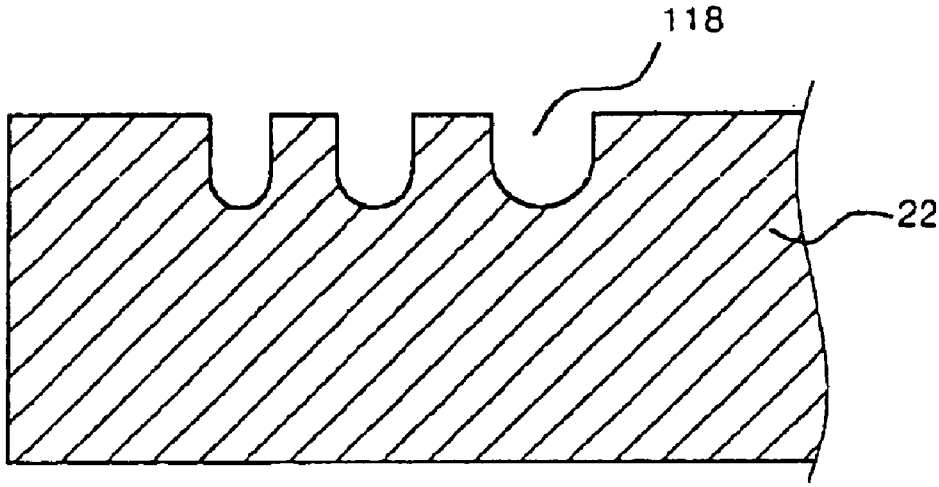

FIGS. 10A and 10B show sections of the cavities 118 of the grooves 220.

The sections of the cavities 118 are triangle-shaped as shown in FIG. 10A or U-shaped as shown in FIG. 10B.

As described hereinbefore, the valve plate structure of the invention damps vibration and noise generated from collision between the valve plate and the suction and discharging valves. The groove(s) formed of the spiral cavity or the plurality of cavities can damp vibration and noise having wide bands of frequency and amplitude.

What is claimed is:

1. A valve plate structure comprising:

open/shut means for inhaling and discharging fluid through piston movement, said open/shut means including a suction plate and a discharge plate; and a valve plate including a suction port coupled with the open/shut means for inhaling fluid through piston movement, a discharge port for discharging fluid through piston movement and a groove section having a plurality of continuous grooves provided to each surround at least a majority of the outside of the suction port or the discharge port, said plurality of continuous grooves being located beyond an edge of said suction plate or said discharge plate, wherein in a direction extending away from a center of the suction port or the discharge port of the valve plate, each successive one of the continuous grooves has an increasingly greater width than a width of an adjacent continuous groove disposed immediately inside thereof, whereby vibration and noise in various frequency bands generated from the collision of the suction valve or the discharge valve with the valve plate are reduced.

2. The valve plate structure according to claim 1, wherein the open/shut means includes:

a suction valve having said suction plate at a position corresponding to the suction port of the valve plate to intake fluid through piston movement;

a discharge valve having said discharge plate at a position corresponding to the discharge port of the valve plate to discharge fluid; and a head cover having a suction tube formed at a position corresponding to the suction port of the valve plate and a discharging tube formed at a position corresponding to the discharge port of the valve plate.

3. The valve plate structure according to claim 1, wherein the fluid is a coolant.

4. The valve plate structure according to claim 1, wherein each one of the plurality of continuous grooves is a closed groove formed so as not to come in contact with a perimeter of the valve plate.

5. The valve plate structure according to claim 1, wherein the grooves are circles when viewed from a top of the valve plate.

6. The valve plate structure according to claim 1, wherein the grooves are polygons when viewed from a top of the valve plate.

7. The valve plate structure according to claim 1, wherein the grooves are fixed in depth.

8. The valve plate structure according to claim 1, wherein the plurality of continuous grooves includes at least one circular groove, at least one rectangular groove, and at least one octagonal groove when viewed from direction perpendicular to a plane of the valve plate.

9. The valve plate structure according to claim 1, wherein each of the continuous grooves has a cross-sectional shape of an inverse triangle to rapidly decrease in width extending downward in a depth direction.

10. The valve plate structure according to claim 1, wherein the continuous grooves are U-shaped in a cross-section to gradually decrease in width extending downward in a depth direction.

11. The valve plate structure according to claim 1, wherein opening or closing functions of the open/shut means, are operated via a pressure difference.

12. The valve plate structure according to claim 1, wherein each one the plurality of continuous grooves completely surrounds the outside of the suction port or the discharge port.

13. A valve plate structure comprising:

open/shut means for inhaling or discharging fluid through piston movement, said open/shut means including a suction plate and a discharge plate; and a valve plate including a suction port coupled to the open/shut means for inhaling fluid through piston movement, a discharge port for discharging fluid through piston movement and a continuous groove spirally provided to surround the outside of the suction port or the discharge port, the continuous groove being located beyond an edge of said suction plate or said discharge plate, wherein a width of the continuous groove increases steadily as the groove spirals outward from the suction port or the discharge port, whereby vibration and noise in various frequency bands generated from the collision of the suction valve or the discharge valve with the valve plate are reduced.

14. The valve plate structure according to claim 13, wherein as the continuous spiral groove spirals outward from the suction port or the discharge port, a gap between adjoining portions of the spiral increases steadily in size.

15. A valve plate structure comprising:

a suction valve to intake a low pressure coolant through a linear reciprocating movement of a piston, and including a suction plate and a discharge plate opening and shutting in response to the reciprocating movement;

a valve plate coupled with the suction valve, and including a suction port for inhaling the low pressure coolant through the piston movement, a discharge port for discharging a high pressure coolant through piston movement, and a groove section having a plurality of continuous grooves provided to each surround at least a majority of the outside of the suction port or the discharge port;

a discharge valve coupled with the valve plate for discharging the high pressure coolant through the reciprocating movement of the piston, and opening and the shutting in response to the reciprocating movement; and a head cover coupled with the discharge valve, and including a suction tube formed at a position corresponding to the suction port of the valve plate and a discharging tube formed at a position corresponding to the discharge port of the valve plate, wherein said plurality of continuous grooves are located beyond an edge of said suction plate or said discharge plate, and in a direction extending away from a center of the suction port or the discharge port of the valve plate, each successive one of the continuous grooves has an increasingly greater width than a width of an adjacent continuous groove disposed immediately inside thereof, whereby vibration and noise in various frequency bands generated from the collision of the suction valve or the discharge valve with the valve plate are reduced.

16. The valve plate structure according to claim 15, wherein the suction valve, the valve plate, the discharge valve and the head cover are coupled via a bolt.

17. The valve plate structure according to claim 15, wherein each one of the plurality of continuous grooves completely surrounds the outside of the suction port or the discharge port.

* * * * *